US010400359B2

(12) United States Patent
Stephan

(10) Patent No.: US 10,400,359 B2
(45) Date of Patent: Sep. 3, 2019

(54) METHOD FOR OPERATING A TEXTILE MACHINE, AND A TEXTILE MACHINE

(71) Applicant: Rieter Ingolstadt GmbH, Ingolstadt (DE)

(72) Inventor: Adalbert Stephan, Beilngries/Paulushofen (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 318 days.

(21) Appl. No.: 15/478,627

(22) Filed: Apr. 4, 2017

(65) Prior Publication Data

US 2017/0283993 A1 Oct. 5, 2017

(30) Foreign Application Priority Data

Apr. 4, 2016 (DE) ..... 10 2016 106 107

(51) Int. Cl.
*D01H 4/42* (2006.01)
*D01H 4/48* (2006.01)
(Continued)

(52) U.S. Cl.
CPC ..... *D01H 4/42* (2013.01); *B65H 54/22* (2013.01); *B65H 67/00* (2013.01); *B65H 69/06* (2013.01);
(Continued)

(58) Field of Classification Search
CPC ..... D01H 4/42–52; D01H 9/00; D01H 9/005; D01H 15/00–013; B65H 54/22;
(Continued)

(56) References Cited

U.S. PATENT DOCUMENTS 2,783,950 A 3/1957 Furst
3,798,624 A * 3/1974 Baxter ..... G05B 11/00 700/73
(Continued)

FOREIGN PATENT DOCUMENTS

DE 11 19 734 12/1961
DE 20 2005 022126 U1 6/2014
(Continued)

OTHER PUBLICATIONS

EP Search Report, dated Sep. 15, 2017.
German Patent Office Search, dated Dec. 1, 2016.

*Primary Examiner* — Ismael Izaguirre
(74) *Attorney, Agent, or Firm* — Dority & Manning, P.A.

(57) ABSTRACT

A method is provided for operating a textile machine having a plurality of work stations wherein, during normal operation of the work stations, a yarn is produced or is rewound from a delivery coil onto a receiver coil. The normal operation is initiated at the individual work stations after a stop of the textile machine, or is interrupted at certain time intervals by a service operation in the form of a piecing process, a tube changing process, or a yarn joining process. The service operations are divided into several partial sequences. A pending partial sequence for one of the service operations is carried out so long as energy resources required for carrying out the pending partial sequence are available independent of whether the energy resources for carrying out the other partial sequences for the service operation are available.

11 Claims, 4 Drawing Sheets

(51) Int. Cl.

| | |
|---|---|
| ***D01H 9/00*** | (2006.01) |
| ***D01H 15/00*** | (2006.01) |
| ***B65H 54/22*** | (2006.01) |
| ***B65H 67/00*** | (2006.01) |
| ***B65H 69/06*** | (2006.01) |

(52) U.S. Cl.
CPC ..... *D01H 4/48* (2013.01); *D01H 9/00* (2013.01); *D01H 15/00* (2013.01)

(58) Field of Classification Search
CPC ..... B65H 54/24; B65H 54/26; B65H 67/00; B65H 69/06
See application file for complete search history.

(56) References Cited

U.S. PATENT DOCUMENTS

| | | | | | |
|---|---|---|---|---|---|
| 4,296,889 | A * | 10/1981 | Martens | B65H 54/36 | 242/477.6 |
| 4,532,759 | A * | 8/1985 | Bischofberger | B65H 54/26 | 242/473.6 |
| 5,353,582 | A * | 10/1994 | Citterio | D01H 4/50 | 57/263 |
| 5,386,684 | A * | 2/1995 | Simon | B65H 54/26 | 57/264 |
| 6,574,526 | B1 * | 6/2003 | Gaukler | D01H 1/16 | 700/139 |

FOREIGN PATENT DOCUMENTS

| | | |
|---|---|---|
| EP | 3 168 179 A1 | 5/2017 |
| GB | 752882 | 7/1956 |
| JP | H 09 21021 A | 1/1997 |

* cited by examiner

METHOD FOR OPERATING A TEXTILE MACHINE, AND A TEXTILE MACHINE

FIELD OF THE INVENTION

The present invention relates to a method for operating a textile machine with a multiple number of similar work stations, whereas, with the assistance of the work stations during normal operation, yarn is produced or is rewound from a delivery coil onto a receiver coil. Normal operation is initiated at the individual work stations after a stop of the textile machine, or is interrupted at certain time intervals by a service operation in the form of a piecing process, a tube changing process, or a yarn joining process.

A textile machine with a multiple number of similar work stations for producing yarn or for rewinding yarn from a delivery coil onto a receiver coil is also proposed, wherein lines are provided for transporting energy resources, and wherein the work stations feature devices for carrying out a piecing process, a tube changing process, and/or a yarn joining process.

BACKGROUND

Textile machines conforming to this type can be formed as spinning machines, which serve to produce a yarn from a fiber composite, or as winding machines, whereas the latter are formed to rewind yarn from delivery coils onto receiving coils and, in doing so, preferably to remove yarn defects from the yarn. The spinning machines may be, for example, ring, rotor or air-jet spinning machines. Normal operation of such textile machines is repeatedly interrupted.

The reasons for such interruptions of normal operation are manifold. One reason is a thread break. Another reason is a clearer cut; that is, the deliberate cutting out of a thread section, because it was too thick, too thin, or too dirty, or has not satisfied the requirements for some other reason. An interruption in normal operation also arises if a full tube has to be exchanged for an empty tube at a work station. An interruption in normal operation at all work stations (that is, a stop of the textile machine) occurs, for example, upon a batch change; that is, if the textile machine is switched to the production of another thread (alternative designation: yarn).

After each of these interruptions, a service operation is needed to restore normal operation. In general, such service operations require energy resources, whereas only a limited number of energy resources are available at a textile machine. So that the required energy resources do not exceed the available energy resources, only a certain number of service operations are carried out simultaneously. Any pending service operations beyond this must wait until a running service operation is terminated and capacity is thereby free again. During this waiting period, the productivity of the textile machine is reduced.

SUMMARY

A task of the present invention is to improve the operation of the textile machine so that the productivity of the textile machine is increased. Additional objects and advantages of the invention will be set forth in part in the following description, or may be obvious from the description, or may be learned through practice of the invention.

The tasks are achieved by a method for operating a textile machine and a textile machine with the characteristics set forth herein.

A method for operating a textile machine with a multiple number of similar work stations is proposed. With the assistance of the work stations, yarn is produced during the normal operation of the work stations, or yarn is rewound from a delivery coil onto a receiving coil. Thus, in the case of the production of yarn, the textile machine comprises a spinning machine. In this case, it is irrelevant for the present invention whether it comprises a ring, a rotor, or an air-jet spinning machine, or another spinning machine. For the case of the rewinding from a delivery coil onto a receiver coil, the textile machine is then formed as a winding machine.

After a stop of the textile machine, for example after a batch change, normal operation is initiated by a service operation. In the case of a spinning machine, such service operation is, for example, a piecing process. However, normal operation can also be interrupted at certain time intervals by a service operation, for example a piecing process, a tube changing process, or a yarn joining process. Thereby, such service operations can be carried out both by devices that are assigned to one or a few work stations and by service devices that can be moved to individual work stations. However, the method is preferably carried out with textile machines, the work stations of which, in each case individually or in pairs, are equipped with service devices of their own, which service devices are arranged in a fixed position. As an alternative or in addition, service devices that can be moved along the work stations, for example in the form of service robots known in principle in the state of the art, can also be used.

In accordance with the invention, at least one of the specified service operations is divided into several partial sequences. Such partial sequences are carried out successively, but a pause can be inserted after each or individual partial sequences. A pending partial sequence is carried out independently of the other partial sequences of the corresponding service operation, if the required energy resources for carrying out the pending partial sequence are available. Therefore, the required energy resources must only be available for the next partial sequence, and not for the entire service operation. Thus, partial sequences of a service operation can also be processed if the required energy resources are not yet available for the entire service operation. As a result, the energy resources of the textile machine are better utilized, and the productivity of the textile machine is thus increased.

It may occur that the energy resources required by the pending partial sequences exceed the available energy resources. It is then advantageous if the selection of the partial sequence to be carried out next takes place in such a manner that the productivity of the textile machine is maximized. For example, yarn joining processes are pending for two work stations, whereas the first partial sequence is pending at one work station and the last partial sequence of this service operation is pending at the other work station. If the energy resources are not present for both partial sequences, the partial sequence for the work station at which the last partial sequence is pending, is initially carried out, since this work station can then continue with normal operation and productivity is thus increased.

In the event that the energy resources required by the pending partial sequences exceed the available energy resources, it is also advantageous if the partial sequence, which is assigned to the work station that operates the most rapidly or most reliably, and/or resumes normal operation the most rapidly or most reliably, is carried out next. If, for example, a piecing process is to be carried out for two work stations, and the free energy resources are sufficient only for one piecing process, that piecing process is first carried out at the work station that spins more rapidly and/or more reliably or that, according to experience, can be pieced more rapidly and/or more reliably. This increases the productivity of the textile machine.

Advantageously, the quantity of at least one consumed energy resource, one required energy resource, and/or one available energy resource is stored in an accumulator and is retrieved. Here, it is possible to, for each partial sequence of a service operation, use a value or—which is more complex, but more accurate—use separately calculated values for each work station. With the assistance of such information, it is possible in both cases to calculate rapidly and easily whether or not sufficient energy resources are available for a pending partial sequence.

It is also advantageous if the quantity of at least one consumed energy resource and/or one available energy resource is measured during the running operation of the textile machine. The resulting measured values are then used for the calculation of the energy sources that are required or are available. Thus, fluctuations in energy requirements and, in particular, in the available energy resources can be taken into account, and the available energy resources can be utilized even better.

It is advantageous if the energy resources are respectively taken into account within their natural units of work stations. For example, the power supply of a textile machine is usually centrally controlled—in this case, the natural units of work stations would be all work stations. On the other hand, the supply of negative pressure is often realized separately per machine side. In this case, the natural unit of work stations is the work station of one machine side each. Through this classification, the energy resources are taken into account as they are also available—thus, a work station from one machine side cannot rely on the negative pressure from the other machine side.

Advantageously, the energy resources comprise electrical current, compressed air, and/or negative pressure, since these are the most frequently required energy resources in textile machines. However, the method presented can also be used for other energy resources without any difficulty.

It is advantageous if the partial sequences of the piecing process comprise a thread search process and a work station start-up process. This division is advantageous for two reasons—on the one hand, it is easily possible to interrupt the piecing process after the thread search process; for retaining the thread end that is found, it is usually the case that no or only very small energy resources are required. On the other hand, a high amount of negative pressure is required for the thread search process, while more electrical current is required for the work station start-up process. Thus, through this division of the partial sequences, the available energy resources can be optimally utilized.

In the case of a tube changing operation, it is advantageous if this features a deceleration process, a tube exchange process, and a work station start-up process. During the deceleration process, a tube, which rotates around its longitudinal axis and onto which a thread has been wound to a cop, is decelerated and, if necessary, brought to a standstill. The tube, which is rotating only slowly or even no longer rotating, is then replaced by an empty tube during the tube exchange process. This is followed by the work station start-up process, by which the empty tube is once again set in rotation and the work station resumes its normal operation after the gripping of the yarn coming from a spinning unit or a delivery coil by the tube. Here as well, interruptions are usually possible between the partial sequences without any difficulty, and the partial sequences once again differ through their energy requirements.

Finally, for the case of a yarn joining operation, it is advantageous if the operation comprises a thread search process, a splicing process, and a work station start-up process. Such a yarn joining process is necessary, for example, after a thread breakage or a clearer cut. A free thread end on a partially wound tube is then initially sought in the thread search process, for example with a suction tube operating with negative pressure. This thread end is then combined with a freshly spun thread (for spinning machines) or with a thread from the delivery coil (for winding machines) and connected in the splicing process. Finally, the work station start-up process is followed again, such that the work station can start its normal operation. This division of the partial sequences again allows interruptions between the partial sequences, and the partial sequences have different energy requirements, which as a whole increases the productivity of the textile machine.

The specified method is carried out according to the preceding description, whereas the specified features can be realized individually or in any desired combination.

A textile machine with a multiple number of similar work stations for producing yarn or for rewinding yarn from a delivery coil onto a receiving coil is also proposed. Thus, the textile machine may be a spinning machine or a winding machine. The textile machine features lines for transporting energy resources, for example electrical current, negative pressure, or compressed air. In addition, the work stations feature devices for carrying out service operations. Such service operations include a piecing process, a tube changing process, and/or a yarn joining process.

In accordance with the invention, the textile machine features a control unit or is in operative connection with a control unit. The control unit is designed in such a manner that it operates the textile machine according to the method described above. In particular, the service operations are divided into several partial sequences. The control unit then initiates the carrying out of a pending partial sequence, independently of the remaining partial sequences of the corresponding service operation, if the required energy resources for this are available.

BRIEF DESCRIPTION OF THE DRAWINGS

The method in accordance with the invention is described in detail in the following example. The following is shown.

DETAILED DESCRIPTION

Figure 1:
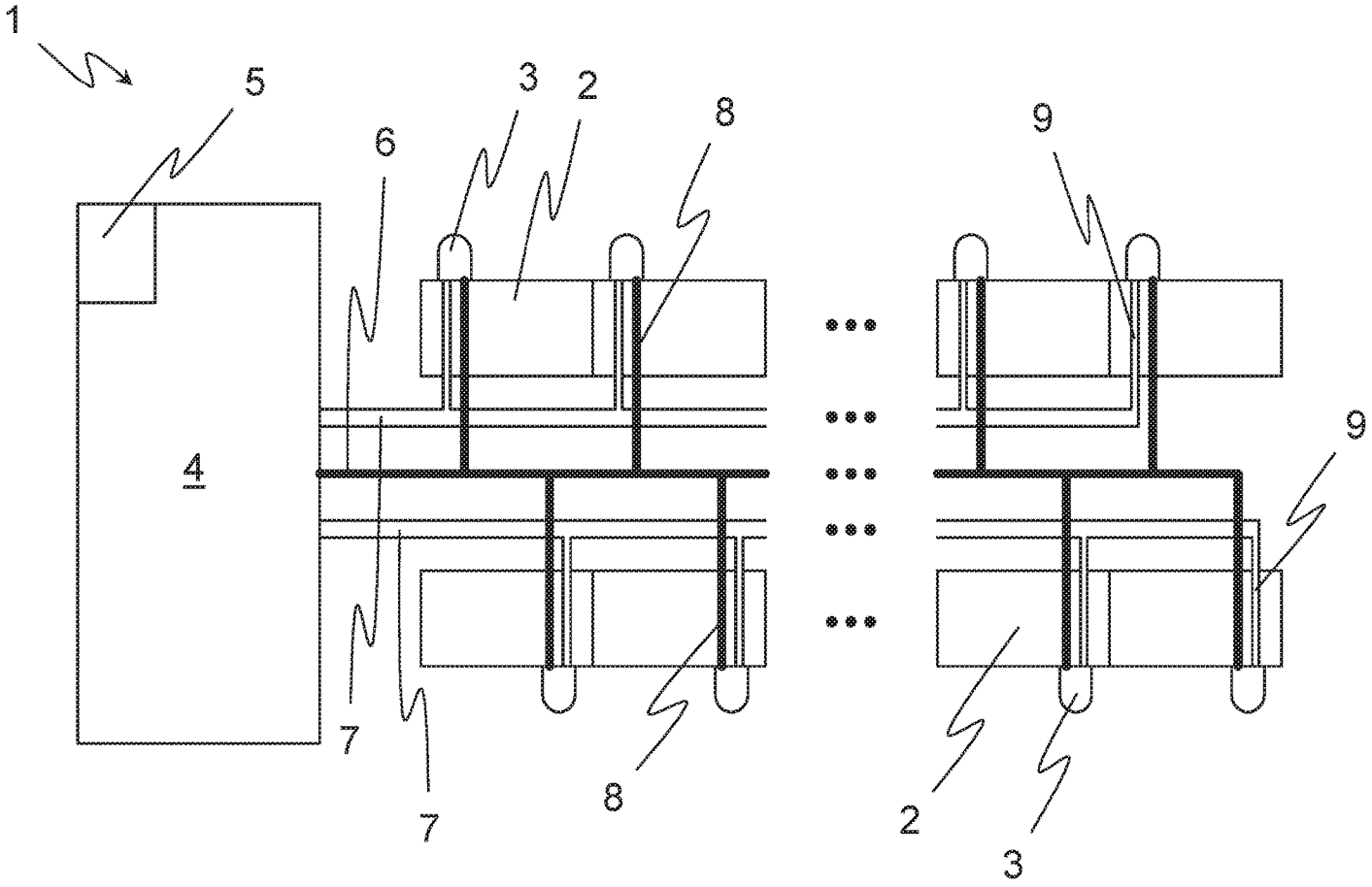
FIG. 1 is a schematic top view of a textile machine in accordance with the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a textile machine 1 in accordance with the invention with a multiple number of work stations 2 (whereas similar sections/components of the textile machine 1 are shown in the same way and, for reasons of clarity, only some of the sections/components are generally provided with reference signs). Each work station 2 features a device 3 for carrying out a service operation, for example a piecing process. At the machine end 4, a control unit 5 is arranged that, among other things, controls the carrying out of the service operations.

A main current line 6 and two main vacuum lines 7 also extend from the machine end 4. The main current line 6 is designed centrally for the entire textile machine 1 and branches into a multiple number of current lines 8, which supply the devices 3 with electrical current. Each of the main vacuum lines 7 is assigned to one machine half. They branch into several vacuum lines 9, which supply the devices 3 with negative pressure.

If a work station 2 now requires a service operation, it issues a request to the control unit 5. The control unit 5 checks whether the energy resources permit the carrying out of a pending partial sequence of such service operation. In this case, the control unit 5 for the electrical current considers the accumulated consumption at all work stations 2 of the textile machine 1. On the other hand, for the consumption of negative pressure—by reason of the separate distribution of the negative pressure over two main vacuum lines 7—only the machine half of the textile machine 1 that is allocated to the work station 2 that has requested the service operation is considered.

If the energy resources required by the pending partial sequence are available, the control unit 5 instructs the device 3 to carry out such partial sequence of the service operation.

In the following figures, the consumption of energy resources of piecing processes on a spinning machine is shown. This is intended to illustrate the method in accordance with the invention; the values shown are freely selected.

Figure 2A:
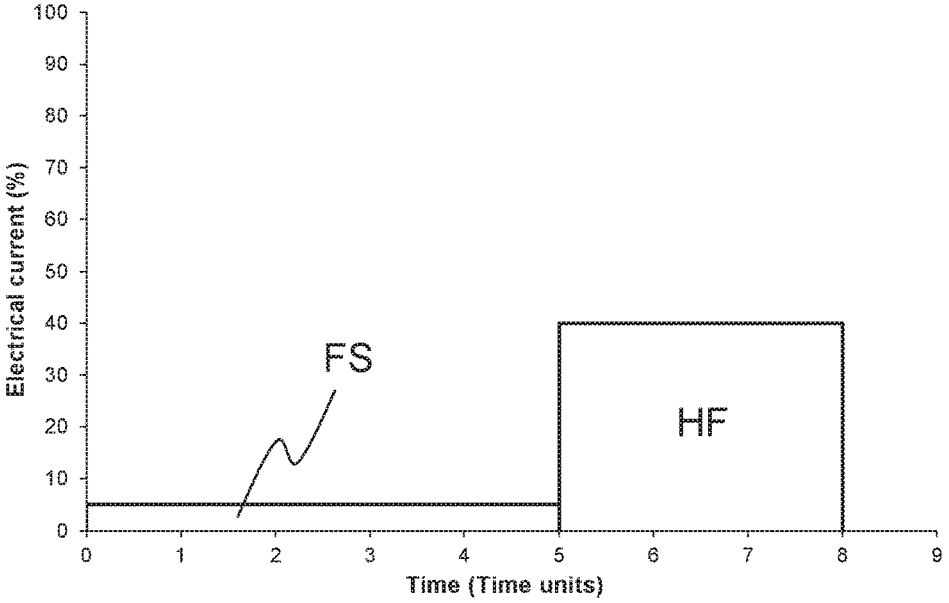
FIG. 2*a* is the consumption of electrical current of a single piecing process.

FIG. 2*a* shows the consumption of electrical current of a single piecing process. Time is plotted on the x-axis in specific time units. The consumption of electrical current as a proportion of the electrical current available in this spinning machine is plotted on the y-axis.

As can be seen in FIG. 2*a*, the piecing process begins with a thread search (FS), which requires only 5% of the available electrical current and lasts five time units. The thread search is followed by the start-up (HF) of the spinning unit. The start-up requires 40% of the available electrical current and lasts three time units. After a total of eight time units, the piecing process is terminated and the work station can start its normal operation.

Figure 2B:
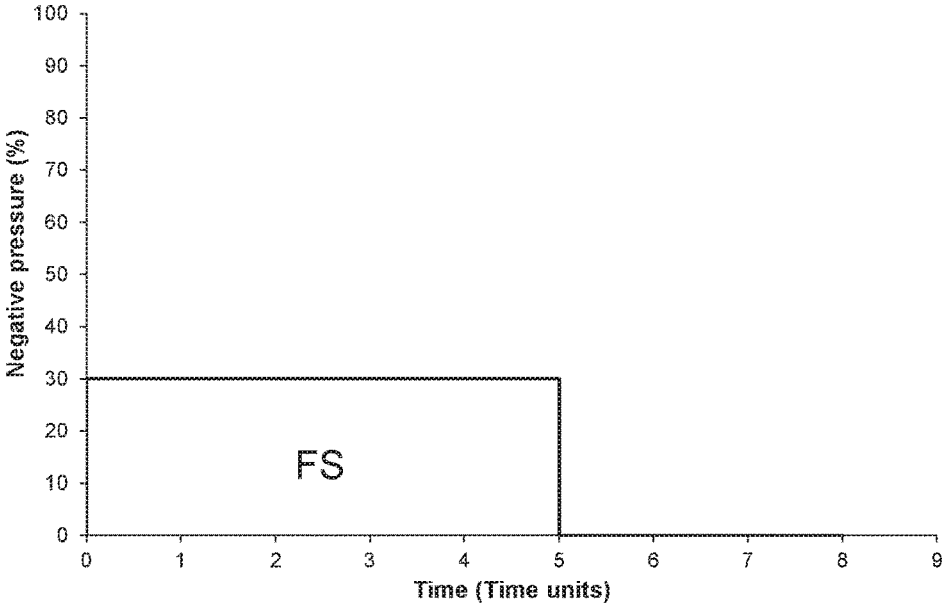
FIG. 2*b* is the consumption of negative pressure associated with the piecing process from FIG. 2*a;*

FIG. 2*b* shows the consumption of negative pressure associated with FIG. 2*a*. The inscriptions are the same as those in FIG. 2*a*, with the sole exception that the consumption of negative pressure is plotted on the y-axis as a proportion of the negative pressure available for such spinning machine. As can be seen from FIG. 2*b*, 30% of the available negative pressure is required for the thread search. The start-up of the work station does not require negative pressure.

Figure 3A:
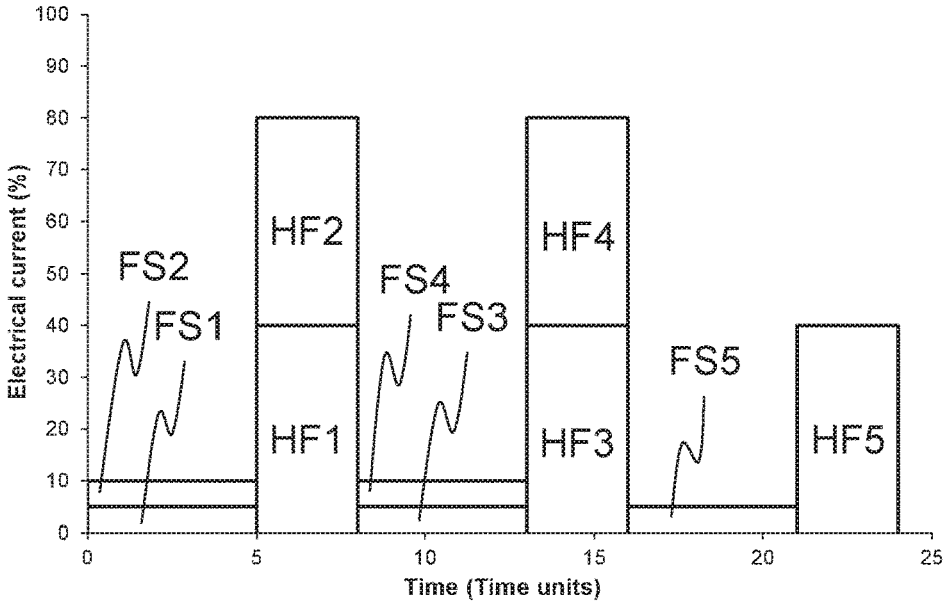
FIG. 3*a* is the consumption of electrical current from piecing processes at five work stations according to the conventional method.
Figure 3B:
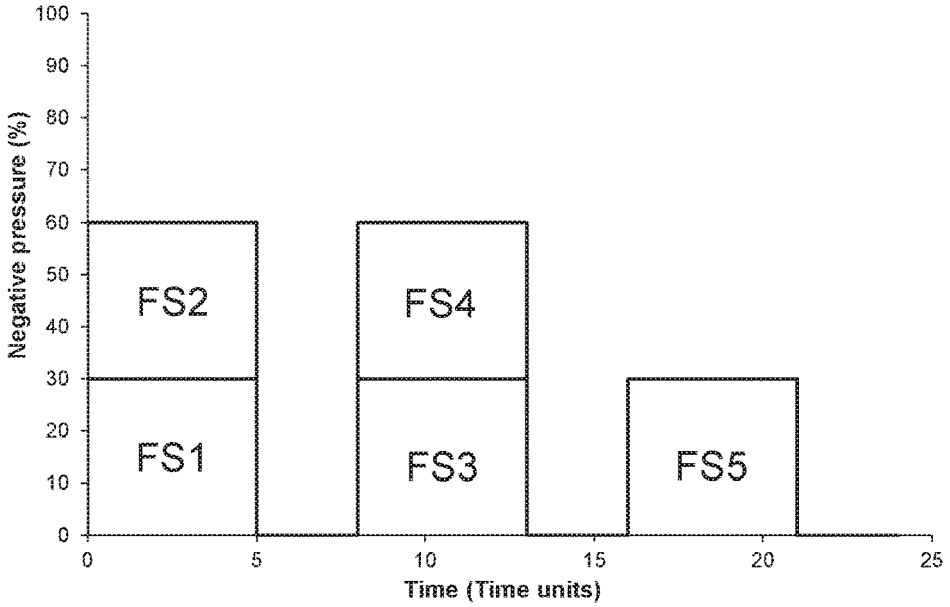
FIG. 3*b* is the consumption of negative pressure associated with the piecing processes from FIG. 3*a;*

FIGS. 3*a* and 3*b* show the consumption of electrical current and/or negative pressure of piecing processes at five work stations according to the conventional method. Here, the designations are the same as those in FIG. 2*a* or 2*b*, as the case may be. It is assumed that all five work stations require a piecing process at time zero.

In this example, with the conventional method, the number of piecing processes that can take place simultaneously is limited by the available electrical current. Since a piecing process requires 40% of the available electrical current upon start-up, a maximum of two piecing processes can take place simultaneously.

Initially, the piecing process is carried out for two work stations. The thread search (FS1 and FS2) is followed by the start-up (HF1 and HF2) of such work stations. During this time, the three other work stations must wait. If the piecing process for the first two work stations has been completed after eight time units, the piecing process for the next two work stations begins. The piecing process once again comprises the thread search (FS3 and FS4) and the start-up (HF3 and HF4) of the work stations. During this time, the first two work stations already work in normal operation and the fifth is still waiting. At time 16, the third and fourth work stations are then also finished with the piecing process and resume normal operation. At that point, the piecing process can begin with thread search (FS5) and start-up (HF5) for the fifth work station. This is completed after a total of 24 time units.

As can be seen in FIGS. 3*a* and 3*b*, the available energy resources are not particularly well utilized in the conventional method. In this example, the cumulative waiting time of the five work stations until the respective normal operation amounts to 72 (=8+8+16+16+24) time units.

Figure 4A:
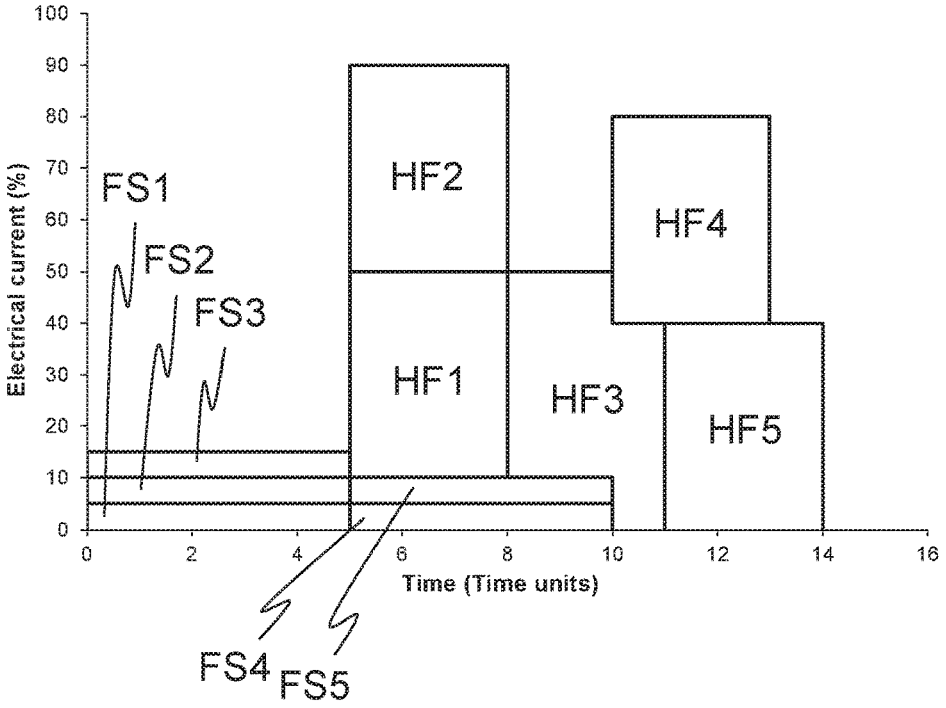
FIG. 4*a* is the consumption of electrical current of piecing processes at five work stations according to the method in accordance with the invention.
Figure 4B:
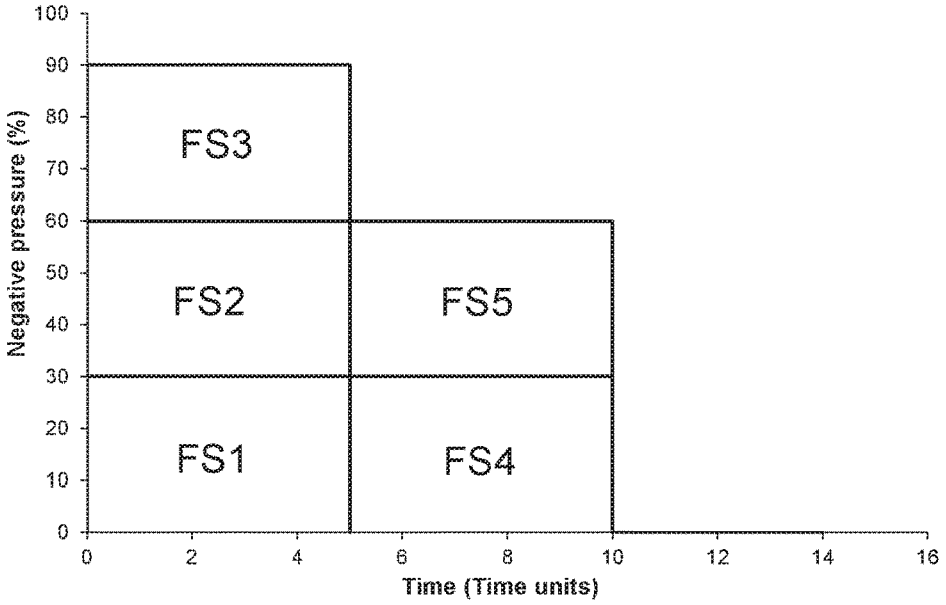
FIG. 4*b* is the consumption of negative pressure associated with the piecing processes from FIG. 4*a*.

With the method in accordance with the invention, which is shown in FIGS. 4*a* and 4*b*, the available energy resources are significantly better utilized. In FIGS. 4*a* and 4*b*, the same designations as in FIGS. 3*a* and 3*b* are used.

In contrast to the conventional method, in the method in accordance with the invention, interruptions can occur between the individual partial sequences.

The thread search is limited by the available negative pressure, and in this example, three work stations can start with the thread search (FS1, FS2 and FS3). As soon as the thread search for such three work stations has been completed, the first two work stations can begin with the start-up (HF1 and HF2). There is not enough electric power available for the start-up of the third work station. However, sufficient energy resources are still available, such that work stations four and five can already start with the thread search (FS4 and FS5).

At time eight, the first two work stations have completed the start-up and can resume normal operation. At that point, enough energy resources are free once again, such that work station three can begin with the start-up (HF3).

Work station four can only start with the start-up (HF4) at time ten, since the thread search was completed only then. At this point in time, work station five has also completed the thread search. However, work station five has to wait for its start-up (HF5) until work station three has completed its start-up at time eleven, and enough electrical current is once again available. At the time 13 and 14, work stations four and five have completed the start-up.

With the method in accordance with the invention, the energy resources are significantly better utilized than with the conventional method. In this example, the cumulative waiting time of the five work stations until the respective normal operation amounts to only 54 (=8+8+11+13+14)

time units, thus 25% less than with the conventional method. With an even higher number of work stations requiring a piecing process, the savings would be even greater.

By means of shorter waiting times, the work stations can more quickly once again proceed with the normal operation of yarn production, and the productivity of the spinning machine is increased.

The present invention is not limited to the illustrated and described examples, and can be modified within the scope of the claims.

The invention claimed is:

1. A method for operating a textile machine having a plurality of work stations, comprising:

during normal operation of the work stations, a yarn is produced or is rewound from a delivery coil onto a receiver coil;

wherein the normal operation is initiated at the individual work stations after a stop of the textile machine, or is interrupted at certain time intervals by a service operation in the form of one or more of a piecing process, a tube changing process, or a yarn joining process;

wherein the service operation is divided into several partial sequences; and wherein a pending partial sequence for the service operation is carried out so long as energy resources required for carrying out the pending partial sequence are available independent of whether the energy resources for carrying out the other partial sequences for the service operation are available.

2. The method according to claim 1, wherein when the energy resources required by all of the pending partial sequences for the service operations at multiple work stations exceed the available energy resources, selection of the partial sequence to be carried out next takes place in such a manner that productivity of the textile machine is maximized.

3. The method according to claim 1, wherein when the energy resources required by all of the pending partial sequences for the service operations at multiple work stations exceed the available energy resources, the partial sequence that is assigned to the work station that operates most rapidly, most reliably, or resumes normal operation the most rapidly or most reliably, is carried out next.

4. The method according to claim 1, wherein a quantity of at least one consumed energy resource, one required energy resource, or one available energy resource is stored in an accumulator.

5. The method according to claim 1, wherein a quantity of at least one consumed energy resource or one available energy resource is measured during normal operation of the textile machine and resulting measured values are used for calculation of the energy resources that are required or are available for the pending partial resources.

6. The method according to claim 5, wherein the number of workstations that an energy resource services during normal operation of the textile machine is taken into account in the calculations.

7. The method according to claim 1, wherein the energy resources comprise electrical current, compressed air, or negative pressure.

8. The method according to claim 1, wherein the partial sequences of the piecing process comprise a thread search process and a work station start-up process.

9. The method according to claim 1, wherein the partial sequences of the tube changing process comprise a deceleration process, a tube exchange process, and a work station start-up process.

10. The method according to claim 1, wherein the partial sequences of the yarn joining operation comprise a thread search process, a splicing process, and a work station start-up process.

11. A textile machine, comprising:

a plurality of work stations for producing yarn or for rewinding yarn from a delivery coil onto a receiving coil;

lines provided for transporting energy resources to the work stations;

each work station configured with one or more devices to carry out one or more of a piecing process, a tube changing process, or a yarn joining process;

a control unit configured to operate the textile machine in accordance with the method of claim 1.

* * * * *